US007566250B1

(12) United States Patent
Good

(10) Patent No.: US 7,566,250 B1
(45) Date of Patent: Jul. 28, 2009

(54) WIRE GROUNDING ASSEMBLY

(75) Inventor: Robert Scott Good, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/147,748

(22) Filed: Jun. 27, 2008

(51) Int. Cl.
*H01R 4/32* (2006.01)

(52) U.S. Cl. ..... 439/779; 439/778; 439/92; 439/95; 174/78

(58) Field of Classification Search ..... 439/778, 439/779, 780, 92, 95, 810, 813; 174/78, 174/135
See application file for complete search history.

(56) References Cited

U.S. PATENT DOCUMENTS

| | | | | |
|---|---|---|---|---|
| 2,148,960 | A * | 2/1939 | Peirce, Jr. | 439/779 |
| 2,197,000 | A * | 4/1940 | Showles | 439/779 |
| 2,260,136 | A | 10/1941 | Bergan | |
| 3,260,987 | A * | 7/1966 | Gunthel, Jr. | 439/779 |
| 4,650,274 | A | 3/1987 | Schmid | |
| 4,828,504 | A | 5/1989 | Franks, Jr. | |
| 5,006,074 | A | 4/1991 | Franks, Jr. | |
| 5,055,056 | A * | 10/1991 | Auclair et al. | 439/98 |
| 5,827,028 | A | 10/1998 | Swick | |
| 5,928,006 | A | 7/1999 | Franks, Jr. | |
| 6,074,121 | A | 6/2000 | Medeiros et al. | |
| 6,082,942 | A | 7/2000 | Swick | |
| 6,111,201 | A | 8/2000 | Drane et al. | |
| 6,142,839 | A | 11/2000 | Deckmann et al. | |
| 6,174,177 | B1 | 1/2001 | Auclair | |
| 6,325,678 | B1 | 12/2001 | Auclair | |
| 6,494,726 | B1 | 12/2002 | Auclair | |
| 6,732,431 | B2 | 5/2004 | Muller | |
| 7,001,125 | B2 | 2/2006 | Wojciechowski et al. | |
| 7,258,517 | B2 | 8/2007 | Ross et al. | |

FOREIGN PATENT DOCUMENTS

CA 2286521 A1 4/2000

OTHER PUBLICATIONS

Service Post Connectors, Blackburn Mechanical, Thomas & Betts, United States and Canada.
Cable Grip, BB Type, Tyco Electronics Simel S.A.S—Energy Division, Gevrey-Chambertin, France.
Lay-In Qiklug Terminal, Catalog No. BGBL, Framatome Connectors USA, Inc., Burndy Electrical, Manchester, NH 03108.

* cited by examiner

*Primary Examiner*—Hien Vu

(57) ABSTRACT

A wire grounding assembly including a unitary bidirectional connector having a first threaded shaft, a second threaded shaft, and a torque-receiving portion that is radially oriented about the major axis of the unitary bidirectional connector and that has a first radial surface and an opposing second radial surface. The first threaded shaft and the second threaded shaft project, respectively, from the first radial surface and the second radial surface, and are aligned such that their respective major axes coincide with the major axis. The first threaded shaft has an axial ground wire slot configured to receive a ground wire therein, and the second threaded shaft has a base. The unitary bidirectional connector has an annular sharp projection that projects beyond the plane of the second radial surface, encircling the base, and is configured to penetrate a non-conductive surface of a ground upon application of sufficient torque to the torque-receiving portion.

12 Claims, 6 Drawing Sheets

WIRE GROUNDING ASSEMBLY

FIELD OF THE INVENTION

The present invention is directed to a wire grounding assembly and, more specifically, to a wire grounding assembly that is especially suitable for use in grounding a photovoltaic module having an anodized aluminum frame.

BACKGROUND OF THE INVENTION

Photovoltaic (PV) modules or arrays produce electricity from solar energy. Electrical power produced by PV modules reduces reliance on electricity generated using non-renewable resources (e.g., fossil fuels), resulting in significant environmental benefits. For the purpose of reducing or eliminating shock and fire hazards, the National Electric Code (NEC) and UL Standard 1703 require the electrical grounding of PV modules. An effective connection to ground reduces the susceptibility of a PV module to damage by lightning, reduces electrostatic buildup (which can damage a PV module), and reduces the risk of harm to personnel who service and repair PV modules. In effect, a connection to ground drains away any excess buildup of electrical charge.

A PV module is usually contained in an anodized aluminum frame, the surface of which is non-conductive. Generally speaking, it is the frame of the PV module that serves as the ground, which renders it challenging for personnel to efficiently install a reliable ground path between the PV module and its frame. While wire grounding assemblies are known devices that are used in establishing grounds, there is no known wire grounding assembly that is especially suitable for grounding a PV module in this manner.

Accordingly, what is needed is a wire grounding assembly that enables personnel to efficiently install a reliable ground path between a PV module and its frame.

SUMMARY OF THE INVENTION

In accordance with one aspect of the present invention, a wire grounding assembly is provided. This assembly includes a unitary bidirectional connector having a torque-receiving portion that is radially oriented about the major axis of the unitary bidirectional connector. The torque-receiving portion has a first radial surface and an opposing second radial surface. The unitary bidirectional connector has a first threaded shaft and a second threaded shaft. The first threaded shaft projects from the first radial surface, and the second threaded shaft projects from the second radial surface. The first threaded shaft and the second threaded shaft are aligned such that their respective major axes coincide with the major axis of the unitary bidirectional connector. The first threaded shaft has an axial ground wire slot configured to receive a ground wire therein, and the second threaded shaft has a base. The unitary bidirectional connector also has an annular sharp projection that projects beyond the plane of the second radial surface, encircling the base of the second threaded shaft. The annular sharp projection is configured to penetrate a non-conductive surface of a ground upon application of sufficient torque to the torque-receiving portion.

In accordance with another aspect of the present invention, a wire grounding assembly is provided that is especially suitable for use in grounding a photovoltaic module having an anodized frame. This assembly includes a unitary bidirectional connector having a torque-receiving portion that is radially oriented about the major axis of the unitary bidirectional connector. The torque-receiving portion has a first radial surface and an opposing second radial surface. The unitary bidirectional connector has a first threaded shaft and a second threaded shaft. The first threaded shaft projects from the first radial surface, and the second threaded shaft projects from the second radial surface. The first threaded shaft and the second threaded shaft are aligned such that their respective major axes coincide with the major axis of the unitary bidirectional connector. The first threaded shaft has an axial ground wire slot configured to receive a ground wire therein, and the second threaded shaft has a base. The unitary bidirectional connector also has an annular sharp projection that projects beyond the plane of the second radial surface, encircling the base of the second threaded shaft. The annular sharp projection is configured to penetrate a non-conductive surface of a ground upon application of sufficient torque to the torque-receiving portion, and has an inner surface and an outer surface. The unitary bidirectional connector has an inner annular groove that is adjacent to the inner surface and is concentric with the annular sharp projection, and it also has an outer annular groove that is adjacent to the outer surface and is concentric with the annular sharp projection.

Among the advantages of the wire grounding assembly of the present invention are that it requires no more than three components (i.e., unitary bidirectional connector, first nut, second nut) and can easily be installed using only a wrench, which unlike other tools (e.g., screwdriver) enables personnel to efficiently apply sufficient torque to establish a reliable ground path, even in applications involving large-gauge grounding wire (e.g., 6-8 AWG), such as the grounding of PV modules.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers are used throughout the drawings to refer to the same or like parts.

DETAILED DESCRIPTION OF THE INVENTION

Figure 1:
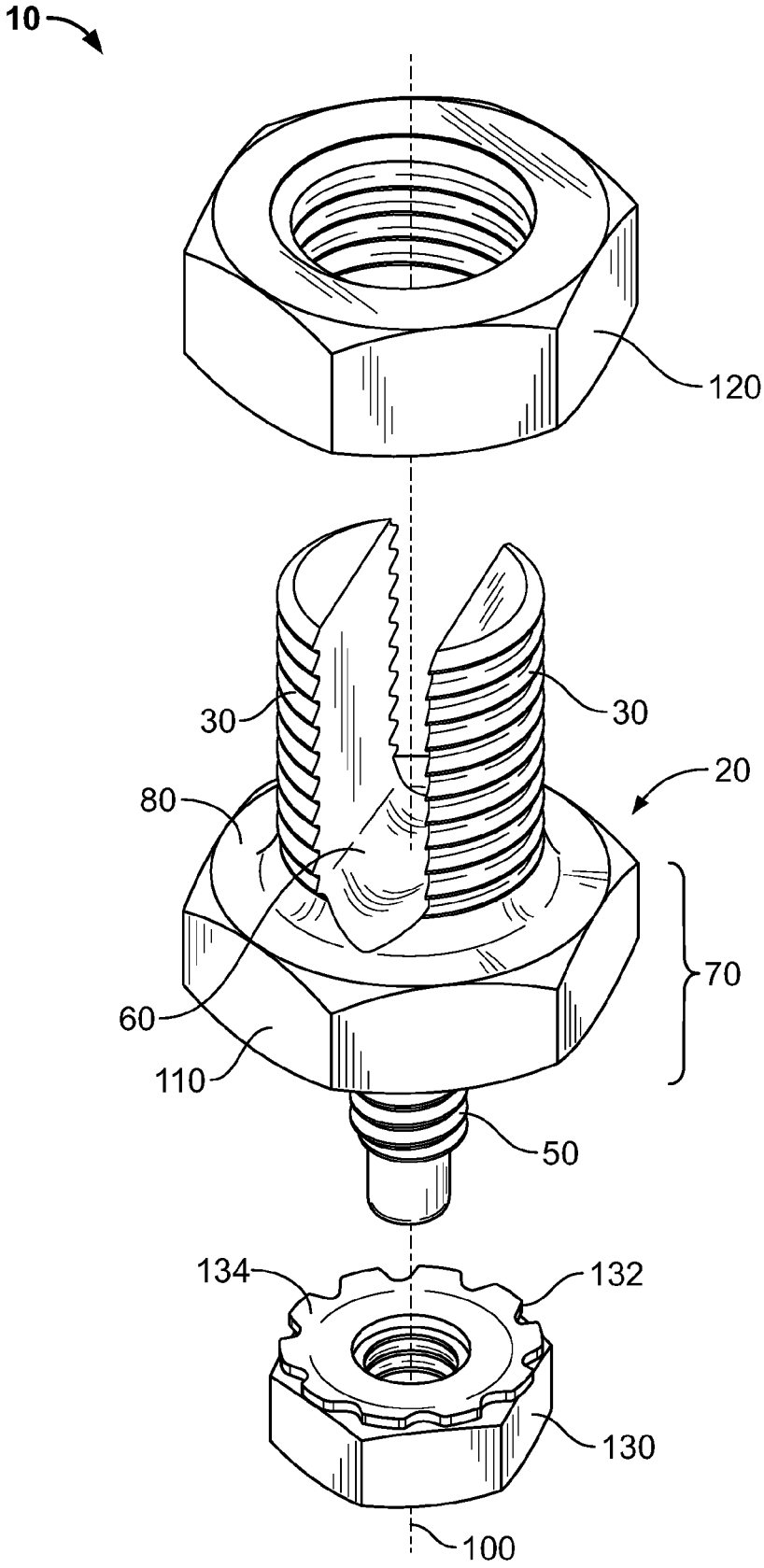
FIG. 1 is an exploded top view, in perspective, of an exemplary embodiment of the disclosed wire grounding assembly.

FIG. 1 is an exploded top view, in perspective, of an exemplary embodiment 10 of the wire grounding assembly of the present invention. Embodiment 10 includes a unitary bidirectional connector 20 having a first threaded shaft 30, a second threaded shaft 50, and a torque-receiving portion 70. First threaded shaft 30 and second threaded shaft 50 are aligned such that their respective major axes coincide with the major axis 100 of unitary bidirectional connector 20. First threaded shaft 30 is slotted along major axis 100, defining a ground wire slot 60 for receiving a ground wire. Torque-receiving portion 70 is radially oriented about major axis 100 and has a first radial surface 80 and an opposing second radial surface (see FIG. 3 at 90). First threaded shaft 30 projects from first radial surface 80, and second threaded shaft 50 projects from second radial surface 90. In a preferred embodiment, the torque-receiving portion 70 has a peripheral surface 110 that is hexagonal, as shown in FIG. 1. This feature allows personnel to apply torque to bidirectional connector 20 using a wrench, facilitating installation of the wire grounding assembly (see FIG. 6).

Embodiment 10 of the wire grounding assembly includes first nut 120, which is dimensioned to engage first threaded shaft 30. Upon application of sufficient torque, first nut 120 will cooperate with unitary bidirectional connector 20 to secure via compression any ground wire of appropriate diameter present in ground wire slot 60. In a preferred embodiment, ground wire slot 60 is dimensioned to receive therein a ground wire. As shown in FIG. 1, first nut 120 is hexagonal. Such a shape is preferred, allowing personnel to apply torque to first nut 120 using a wrench, thereby facilitating installation of the wire grounding assembly.

Embodiment 10 also includes second nut 130, which is dimensioned to engage second threaded shaft 50. The frame 140 (see FIG. 6) of a PV module usually includes apertures 150 (see FIG. 6). Second threaded shaft 50 is dimensioned to engage aperture 150. Second nut 130 cooperates with second threaded shaft 50 of unitary bidirectional connector 20 to secure embodiment 10 to frame 140.

As shown in FIG. 1, second nut 130 is hexagonal, allowing personnel to apply torque to second nut 130 using a wrench. Second nut 130 optionally includes attached free-spinning washer 132. Such a nut is commonly referred to as a KEPS nut, K-nut, or washer nut. As shown in FIG. 1, attached free-spinning washer 132 is a star-type lock washer, which has a serrated surface 134 capable of penetrating the (non-conductive) anodized surface of frame 140, to aid in ensuring proper grounding. Depending on the application, another washer type (e.g., conical washer, flat washer) may be substituted.

Figure 2:
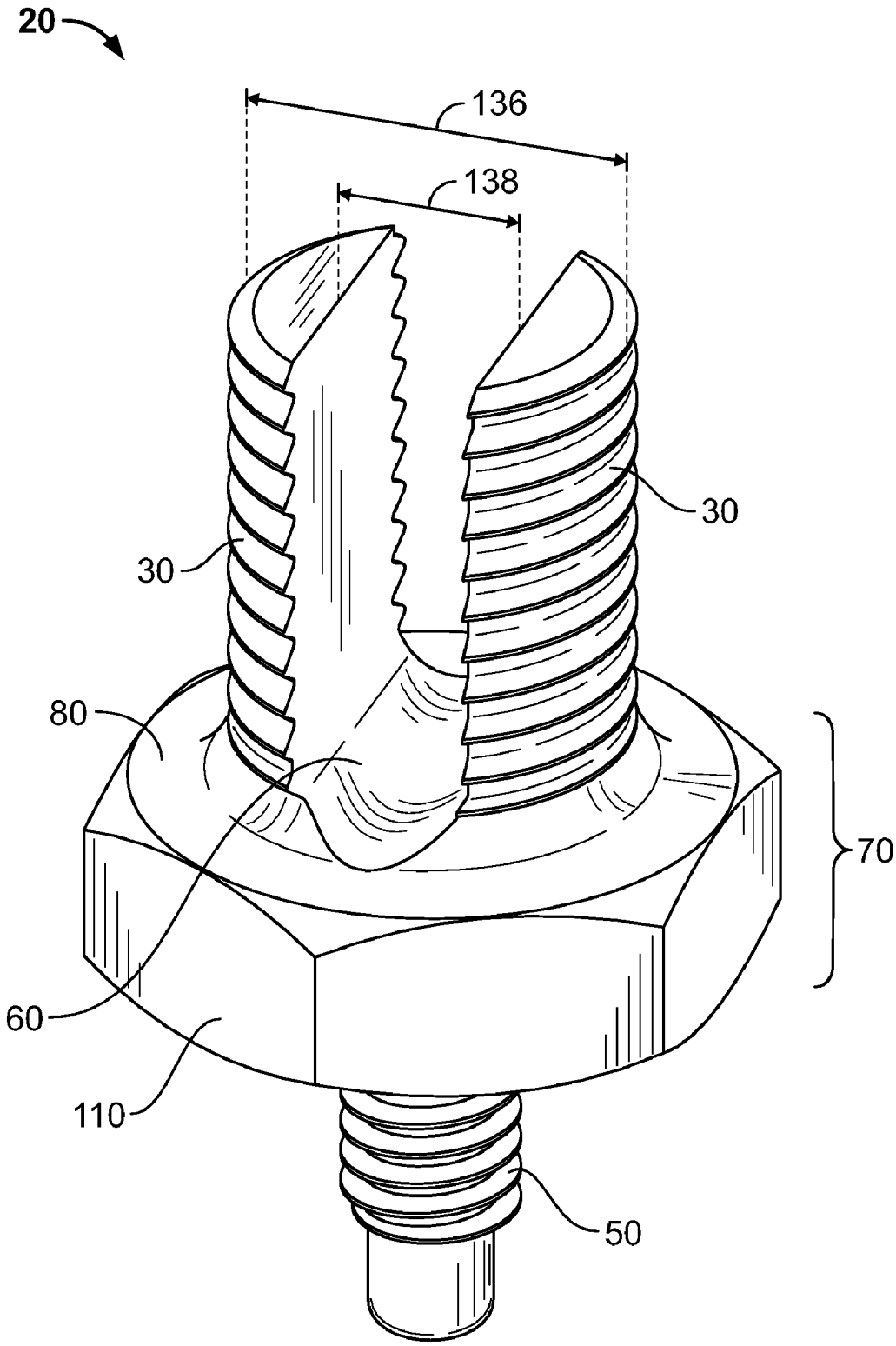
FIG. 2 is an enlarged top view, in perspective, of a component (i.e., unitary bidirectional connector) of the exemplary embodiment shown in FIG. 1.

FIG. 2, which is an enlarged top perspective view of unitary bidirectional connector 20, shows diameter 136, which represents the diameter of first threaded shaft 30, and slot width 138, which represents the width of ground wire slot 60. Diameter 136 of first threaded shaft 30 depends on various factors, including the intended application and the strength of the material using in forming unitary bidirectional connector 20. For various applications, including the grounding of a PV module, UL requires that the ground wire assembly satisfy the requirements of the secureness test (e.g., 6 AWG=18 lbs. for 30 minutes) and the pull-out test (e.g., 6 AWG=100 lbs. for 1 minute). Unitary bidirectional connector 20 is preferably made from an electrically-conductive material that is corrosion resistant (e.g., stainless steel). Such materials have variations in strength. Assuming slot width 138 is constant, diameter 136 of first threaded shaft 30 will vary inversely with the strength of the selected electrically-conductive material. In other words, a weaker material will generally require that diameter 136 be greater. Conversely, diameter 136 may be decreased when stronger materials are used.

Figure 3:
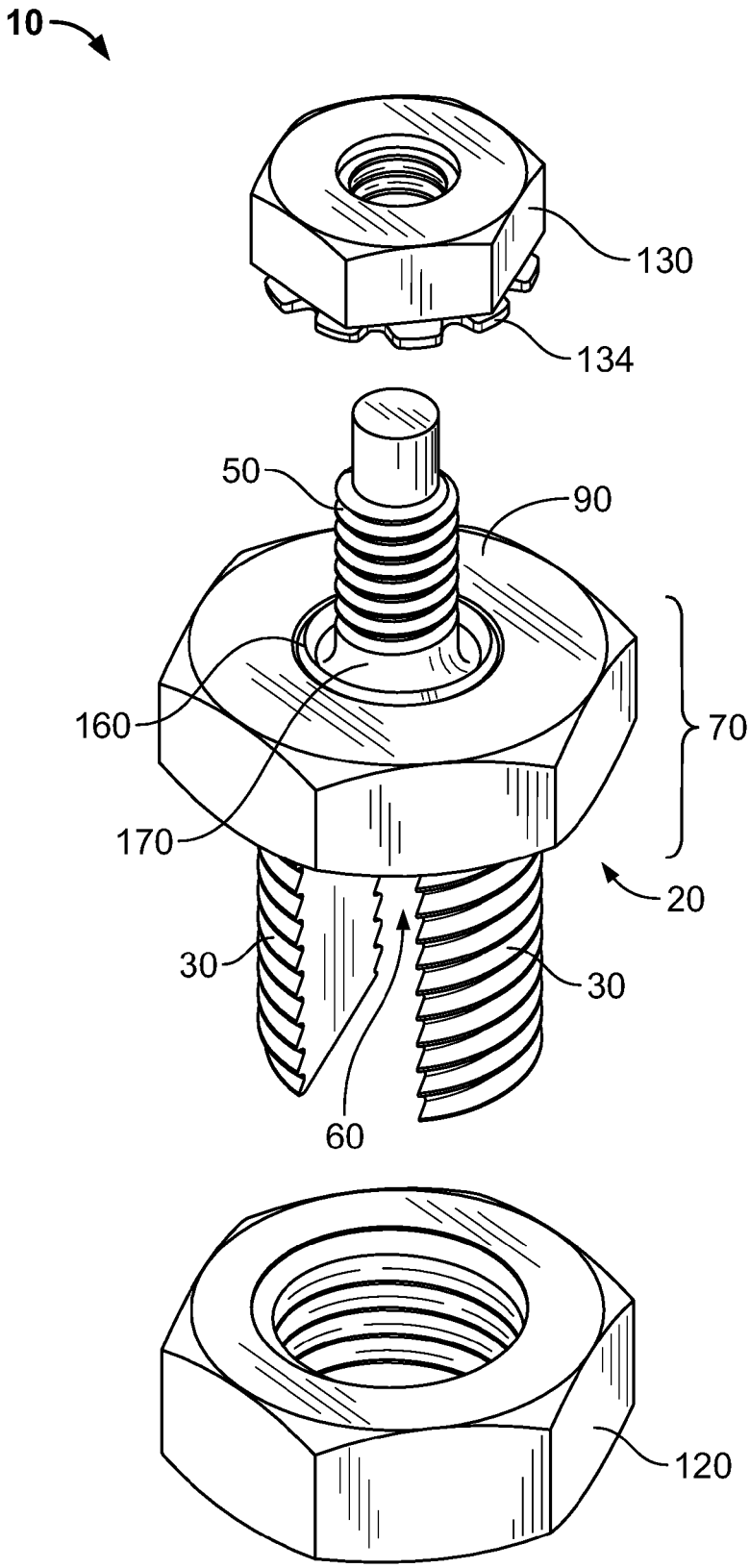
FIG. 3 is an exploded bottom view, in perspective, of the exemplary embodiment shown in FIG. 1.

FIG. 3, which is an exploded bottom view, in perspective, of embodiment 10, discloses additional features of unitary bidirectional connector 20. Annular sharp projection 160 projects beyond the plane defined by second radial surface 90, encircling base 170 of second threaded shaft 50. Annular sharp projection 160 is arranged and disposed to penetrate the anodized surface of frame 140 upon application of sufficient torque to torque-receiving portion 70 (and/or second nut 130). As unitary bidirectional connector 20 is bolted onto frame 140 using second nut 130, annular sharp projection 160 and serrated surface 134 respectively penetrate opposing anodized surfaces of frame 140. Thus, annular sharp projection 160 and serrated surface 134 each aid in establishing a reliable ground path between the PV module and frame 140. Once unitary bidirectional connector 20 is bolted to frame 140, annular sharp projection 160 is sealed between second radial surface 90 and the surface of frame 140. Exposure/corrosion of those regions of frame 140 where the anodized surface has been penetrated is especially undesirable as it can adversely affect the reliability of the ground path.

Figure 4:
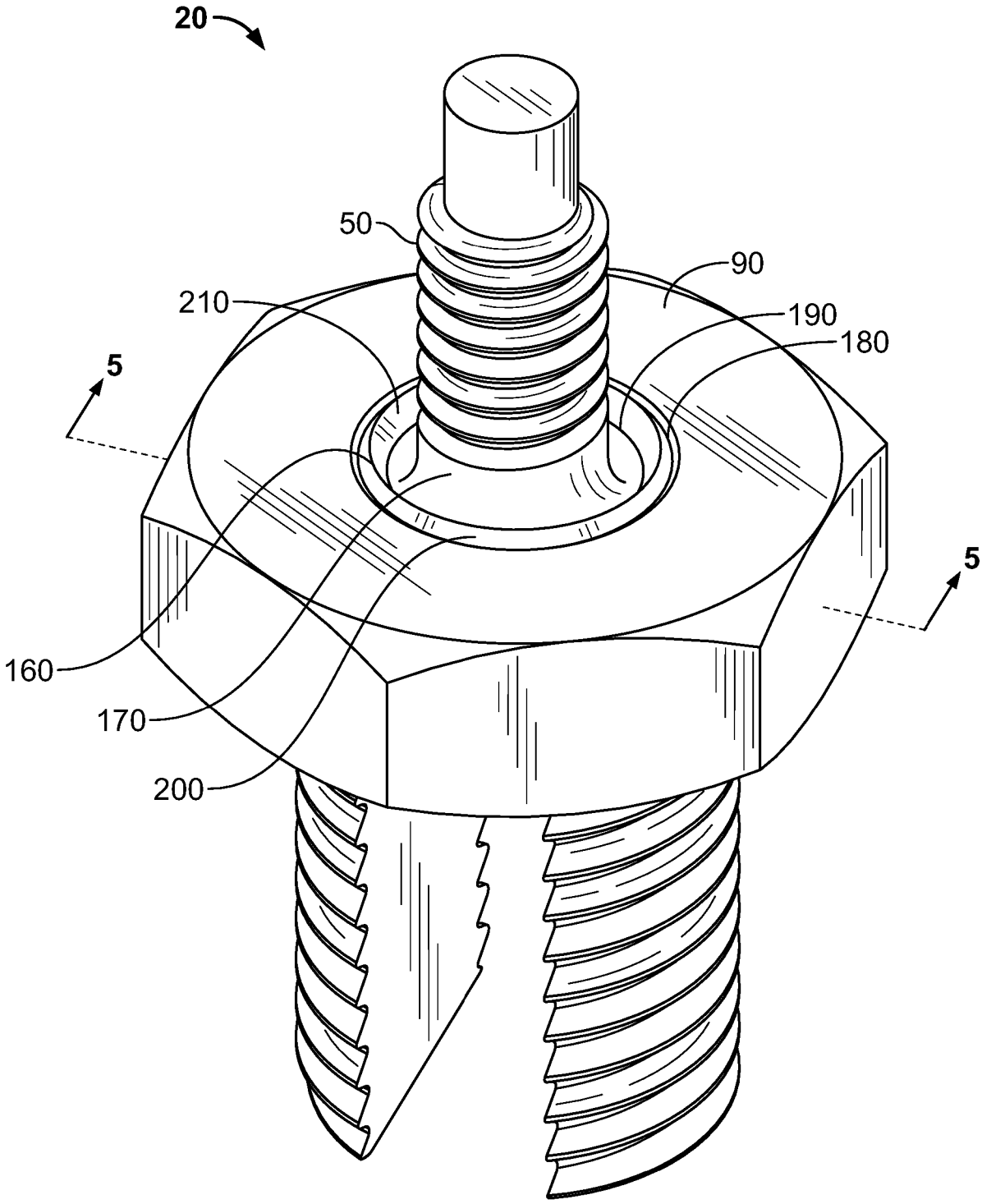
FIG. 4 is an enlarged bottom view, in perspective, of the unitary bidirectional connector shown in FIG. 2.

FIG. 4 is an enlarged bottom view, in perspective, of the unitary bidirectional connector. FIG. 4 shows two optional features, specifically, outer annular groove 180 and inner annular groove 190. Outer annular groove 180, inner annular groove 190, and annular sharp projection 160 are concentric, and major axis 100 (see FIG. 1) passes through their common origin. Outer annular groove 180 is adjacent to outer surface 200 of annular sharp projection 160, and inner annular groove 190 is adjacent to inner surface 210 of annular sharp projection 160. As annular sharp projection 160 penetrates the anodized surface of frame 140, some frame material may be displaced into either outer annular groove 180 or inner annular groove 190 (or both).

Figure 5:
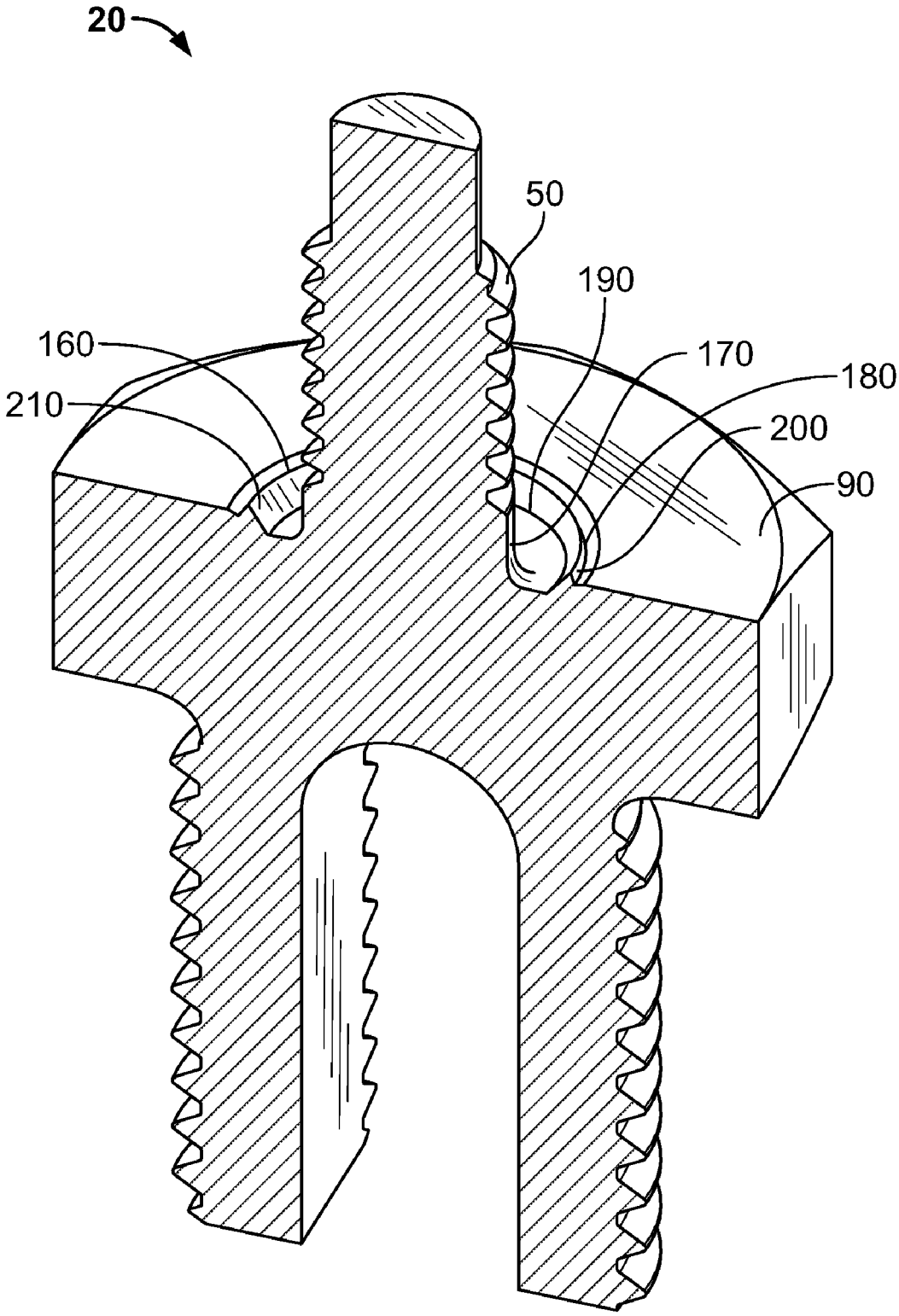
FIG. 5 is a section view, in perspective, of the unitary bidirectional connector taken along line 5-5 of FIG. 4.

FIG. 5 is a section view, in perspective, of the unitary bidirectional connector taken along line 5-5 of FIG. 4. FIG. 5 complements FIG. 4 in showing the relationship among the following features of unitary bidirectional connector 20: annular sharp projection 160, base 170, outer annular groove 180, inner annular groove 190, outer surface 200, and inner surface 210.

Figure 6:
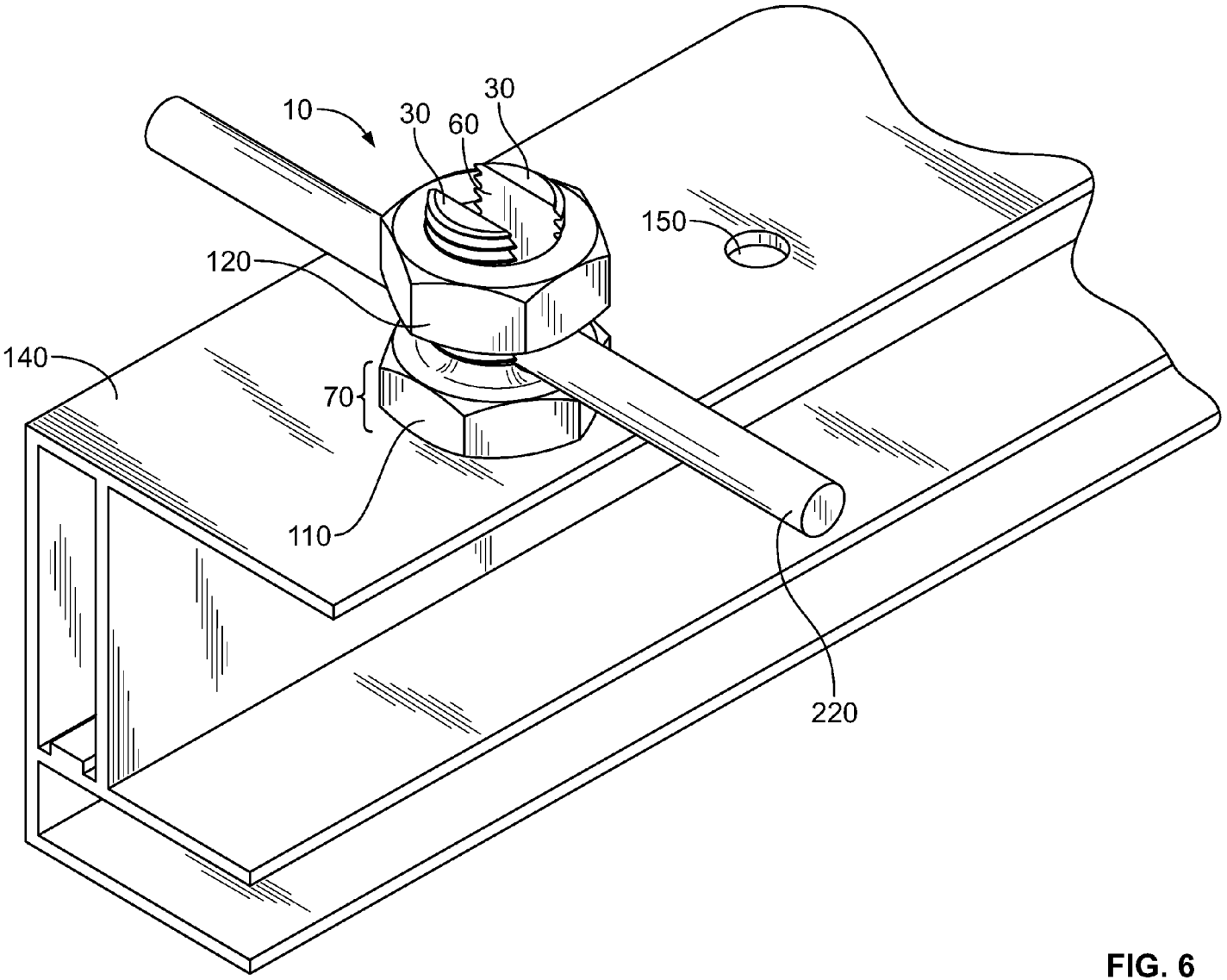
FIG. 6 is a perspective view of the exemplary embodiment of the disclosed wire grounding assembly shown in FIG. 1 installed on the frame of a PV module.

FIG. 6 shows exemplary embodiment 10 of the disclosed wire grounding assembly installed on frame 140 of a PV module. Grounding wire 220 is present in ground wire slot 60 and is secured therein by first nut 120, torque-receiving portion 70, and first threaded shaft 30. First nut 120 usually is tightened to a sufficient torque to compress and hold a grounding wire made of copper (the most common type). Second threaded shaft 50 (see FIGS. 1-5) already has been received by one of apertures 150. Second threaded shaft 50 and second nut 130 (see FIGS. 1, 3) cooperate to secure embodiment 10 to frame 140. Generally, torque-receiving portion 70 (and/or second nut 130) are tightened to a sufficient torque such that annular sharp projection 160 penetrates the anodized surface of frame 140 and such that second radial surface 90 and the surface of frame 140 meet.

Embodiment 10 includes no more than three components (i.e., unitary bidirectional connector 20, first nut 120, second nut 130) and, because of various hexagonal features (e.g., peripheral surface 110), can be easily installed using only a wrench, which unlike other tools (e.g., screwdriver) enables personnel to efficiently apply sufficient torque to establish a reliable ground path, even in applications involving large-gauge grounding wire (e.g., 6-8 AWG), such as the grounding of PV modules.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A wire grounding assembly for use in grounding a photovoltaic module having an anodized frame comprising:

a unitary bidirectional connector having a torque-receiving portion that is radially oriented about a major axis of the unitary bidirectional connector, the torque-receiving portion having a first radial surface and an opposing second radial surface;

the unitary bidirectional connector further having a first threaded shaft and a second threaded shaft, the first threaded shaft projecting outwardly from the first radial surface, the second threaded shaft projecting outwardly from the second radial surface, the first threaded shaft and the second threaded shaft being aligned such that their respective major axes coincide with the major axis of the unitary bidirectional connector, the first threaded shaft having an axial ground wire slot configured to receive a ground wire therein, the second threaded shaft having a base;

the unitary bidirectional connector further having an annular sharp projection that projects beyond a plane of the second radial surface, encircling the base of the second threaded shaft, the annular sharp projection being configured to penetrate a non-conductive surface of a ground upon application of sufficient torque to the torque-receiving portion; and the wire grounding assembly further including a second nut dimensioned to engage the second threaded shaft, the second nut having an attached free-spinning washer, the attached free-spinning washer having a serrated surface configured to penetrate the non-conductive surface of an anodized ground of the frame.

2. The wire grounding assembly of claim 1, wherein the annular sharp projection has an outer surface, and wherein the unitary bidirectional connector includes an outer annular groove that is adjacent to the outer surface and is concentric with the annular sharp projection.

3. The wire grounding assembly of claim 1, wherein the annular sharp projection has an inner surface, and wherein the unitary bidirectional connector includes an inner annular groove that is adjacent to the inner surface and is concentric with the annular sharp projection.

4. The wire grounding assembly of claim 1, further including a first nut dimensioned to engage the first threaded shaft to secure via compression a ground wire present in the ground wire slot.

5. The wire grounding assembly of claim 1, wherein the torque-receiving portion has a hexagonal peripheral surface.

6. The wire grounding assembly of claim 1, wherein the unitary bidirectional connector is composed essentially of an electrically-conductive material that is corrosion resistant.

7. A wire grounding assembly especially suitable for use in grounding a photovoltaic module having an anodized frame, the wire grounding assembly comprising:

a unitary bidirectional connector having a torque-receiving portion that is radially oriented about a major axis of the unitary bidirectional connector, the torque-receiving portion having a first radial surface and an opposing second radial surface;

the unitary bidirectional connector further having a first threaded shaft and a second threaded shaft, the first threaded shaft projecting outwardly from the first radial surface, the second threaded shaft projecting outwardly from the second radial surface, the first threaded shaft and the second threaded shaft being aligned such that their respective major axes coincide with the major axis of the unitary bidirectional connector, the first threaded shaft having an axial ground wire slot configured to receive a ground wire therein, the second threaded shaft engaging with a second hexagonal nut having an attached free-spinning washer and having a base;

the unitary bidirectional connector further having an annular sharp projection that projects beyond a plane of the second radial surface, the attached free-spinning, encircling the base of the second threaded shaft, the annular sharp projection being configured to penetrate a non-conductive surface of a ground upon application of sufficient torque to the torque-receiving portion, the annular sharp projection having an inner surface and an outer surface;

the unitary bidirectional connector further having an inner annular groove that is in between to the inner surface and the base, and is concentric with the annular sharp projection; and the unitary bidirectional connector further having an outer annular groove that is in between to the outer surface and the second radial surface, and is concentric with the annular sharp projection.

8. The wire grounding assembly of claim 7, wherein the torque-receiving portion has a hexagonal peripheral surface.

9. The wire grounding assembly of claim 7, further including a first hexagonal nut dimensioned to engage the first threaded shaft to secure via compression a ground wire present in the ground wire slot.

10. The wire grounding assembly of claim 7, wherein the attached free-spinning washer having a serrated surface configured to penetrate the non-conductive surface of the anodized frame.

11. The wire grounding assembly of claim 7, wherein the unitary bidirectional connector is composed essentially of an electrically-conductive material that is corrosion resistant.

12. The wire grounding assembly of claim 7, wherein the unitary bidirectional connector is composed essentially of stainless steel.

* * * * *